US005526985A

United States Patent [19]

Martin

[11] Patent Number: 5,526,985

[45] Date of Patent: Jun. 18, 1996

[54] 90° ROTATION NOZZLE ASSEMBLY WITH SWIRL CHAMBER CONFIGURATION

[75] Inventor: Douglas S. Martin, New Castle, Pa.

[73] Assignee: AFA Products, Inc., Forest City, N.C.

[21] Appl. No.: 309,928

[22] Filed: Sep. 21, 1994

[51] Int. Cl.[6] ..... B05B 1/34

[52] U.S. Cl. ..... 239/478; 239/490

[58] Field of Search ..... 239/476–485, 239/490, 402.5

[56] References Cited

U.S. PATENT DOCUMENTS

| | | | |
|---|---|---|---|
| 3,843,030 | 10/1974 | Micallef | 239/478 |
| 3,967,765 | 7/1976 | Micallef | 239/478 |
| 4,234,128 | 11/1980 | Quinn et al. | 239/478 |
| 4,365,751 | 12/1982 | Saito et al. | 239/490 |
| 4,516,695 | 5/1985 | Garneau | 239/478 |
| 4,706,888 | 11/1987 | Dobbs | 239/478 |

FOREIGN PATENT DOCUMENTS 2-20303 9/1985 Japan .

*Primary Examiner*—Karen B. Merritt
*Attorney, Agent, or Firm*—Thomas R. Vigil

[57] ABSTRACT

The 90° rotation nozzle assembly for a trigger sprayer comprises a nose bushing and a nozzle cap rotatably mounted on the nose bushing. The nose bushing has a front core with a front face and a generally cylindrical periphery. The generally cylindrical periphery has first, second and third, angularly spaced apart, longitudinally extending channels therein which open onto the front face of the core and extend rearwardly therefrom. The nozzle cap includes a front wall having a back side and a cylinder having an inner cylindrical wall surface and extending rearwardly from the back side of the front wall to a rear end of the cylinder. The front wall has a discharge orifice therethrough and the back side of the front wall has a swirl chamber formed therein in the area of and communicating with the discharge orifice. The back side also has first and second nondiametrically disposed radial slots therein that extend radially inwardly from the cylindrical wall surface to the swirl chamber and first and second nondiametrically disposed tangential slots therein that are angularly offset from the radial slots and that extend from the cylindrical wall surface tangentially to the swirl chamber.

16 Claims, 7 Drawing Sheets

90° ROTATION NOZZLE ASSEMBLY WITH SWIRL CHAMBER CONFIGURATION

BACKGROUND OF THE INVENTION

1. Field of the Invention

The present invention relates to a swirl chamber configuration for a nozzle assembly in a trigger sprayer for dispensing liquids where the nozzle cap is rotated 90° clockwise from an "OFF" position to a "SPRAY" or to a "STREAM" position and counterclockwise from the "OFF" position to a "STREAM" or to a "SPRAY" position. More specifically, the invention relates to a configuration of slots and grooves in a nozzle cap and nose bushing assembly in a trigger sprayer that communicate with a swirl chamber located in the nozzle cap or in the nose bushing. The nozzle cap can be rotatably mounted on the nose bushing and has an "OFF" position, a "SPRAY" position and a "STREAM" position. The nozzle cap is rotated 90° in a first direction from the "OFF" position to the "SPRAY" position. The nozzle cap then is rotated 90° in a second direction from the "OFF" position to the "STREAM" position.

2. Description of the related art including information disclosed under 37 CFR §§ 1.97–1.99

Heretofore, various nozzle assemblies and swirl chamber configurations have been proposed which allow liquid to be dispensed from a trigger sprayer in either a stream or spray mode. Several examples of such assemblies are disclosed in the following U.S. Patents and Japanese Patent Publication:

| U.S. Patent No. | Patentee |
|---|---|
| 3,843,030 | Micallef |
| 3,967,765 | Micallef |
| 4,234,128 | Quinn et al. |
| 4,706,888 | Dobbs |

Japanese Laid Open Patent Application 183,065/1985.

The Micallef U.S. Pat. No. 3,843,030 discloses a cylindrical nozzle cap having an eccentrically located discharge orifice located radially outwardly from a center line of the cylindrical nozzle cap and through a front wall of the cap. A tubular member or nozzle bushing having a tubular extension including two diametrically opposed projections extends outwardly from the front end of a sprayer and has a passageway in the middle. In the outer end of one projection is formed a generally cylindrical swirl chamber with two slots extending to the side of the projection and communicating in a tangential manner with the swirl chamber. The other projection merely has an arcuate slot thereacross. When the cap is rotated to place the eccentrically located orifice in communication with the swirl chamber, a spray can be emitted from the sprayer and when the nozzle is rotated to place the orifice over the slot a stream of liquid can be ejected through the outlet orifice.

The Micallef U.S. Pat. No. 3,967,765 discloses a multiple nozzle cap and nose bushing assembly wherein the inner surface of the nozzle cap has diametrically opposed radial slots in the back face of a front wall of the nozzle which communicate with a cylindrical swirl chamber formed in the back face of the front wall of the nozzle cap. Generally parallel thereto and at about an angle of between 10° and 30° from the diameter extending through the radial slots there are tangential slots which provide for generally parallel tangential entry of liquid into the swirl chamber.

In the middle of the swirl chamber and extending through the front wall of the nozzle cap is an outlet orifice.

A nose bushing is provided having diametrically opposed notches which are arranged to communicate pressurized liquid either to the radial slots or to the tangential slots to establish either a stream mode or a spray mode of operation of the multiple purpose nozzle when the cap is rotated 10°–30° in one direction or 330°–350° in the opposite direction, clockwise or counterclockwise.

The Quinn et. al. U.S. Pat. No. 4,234,128 discloses a nozzle assembly for a trigger sprayer where the nozzle cap is rotated through an angle of approximately 60° between an "OFF" position and a "STREAM" position and 60° between a "STREAM" position and a "SPRAY" position.

The nozzle cap has a cylinder therein which extends rearwardly from the back face of a front wall of the nozzle cap. In the center of the front wall is an orifice which communicates with a generally cylindrical swirl cavity formed in the back face of the front wall. A first pair of longitudinally extending, diametrically opposed passages are formed in the inner wall of the cylinder adjacent a rear end thereof. Extending from the inner wall of the cylinder in the back face and in alignment with the longitudinally extending passages are diametrically opposed swirl or turn passages that extend to the swirl cavity.

A nose bushing is provided with a generally cylindrical core which has a pair of diametrically opposed longitudinally extending grooves in an outer periphery thereof that extend rearwardly from a front circular face of the core. The front face of the core also has a transverse diametrically extending slot located approximately 30° away from the ends of the grooves opening onto the front face. The transverse slot is in communication with a waterway in the nose bushing when the cap is rotated to a "STREAM" position and the passages, which are always in communication with the waterway, are in communication with the grooves when the cap is in a spray position.

The Dobbs U.S. Pat. No. 4,706,888 discloses a nozzle assembly for a liquid dispenser where a nozzle cap is rotatably mounted on a fixed plug of a nose bushing.

In the Dobbs nozzle assembly, the plug extends outwardly from the front end of a trigger sprayer and has longitudinal slots therein which communicate with tangential or radial slots in the front face of the plug. In the center front face of the plug there is formed a generally cylindrical swirl chamber. Three radial slots located approximately 120° from each other are provided in the front face of the nose plus and three generally tangential slots, i.e., slots which enter the swirl cavity on a tangent, are formed in the front face of the plug and are displaced from each other by approximately 120°.

The nozzle cap has a cylinder extending rearwardly from the back face of a front wall of the cap and has three longitudinal extending slots which are equidistantly spaced around the cylinder 120° from each other. The longitudinal extending slots in the cylinder extend from a rear end of the cylinder to a position spaced inwardly of the front wall of the nozzle cap and at a position which is behind the slots in the front face of the plug. The cap is positioned on the plug, such that in an "OFF" position the longitudinal slots in the cap do not communicate with any of the longitudinal and radially extending slots in the plug. Then, when the cap is rotated clockwise from the "OFF" position 90°, the slots in the cylinder will be aligned with the radially extending notches in the front face of the plug to establish a "STREAM" mode of operation of the trigger sprayer.

Then, when the cap is rotated 90° from the "OFF" position, a "SPRAY" mode of operation of the trigger sprayer is established where the longitudinal slots in the cap communicate with the tangential slots in the front face of the plug.

Japanese Patent 2-20303 (Japanese Laid-Open Patent Publication No. 183056/1985) discloses a nose bushing having a swirl chamber formed in the front face thereof which is received over a cylinder extending rearwardly from the back face of a front wall of a nozzle cap. The cylinder extending rearwardly from the back face of the nozzle cap has one radial passage and one tangential passage which are located approximately 60° from each other. An outer wall surrounding the swirl cavity at the outer end of the nose bushing plug or core has a tangential passageway therein which will align with the tangential passageway in the cylinder extending from the back face of the front wall when the cap is rotated to one position on the nose bushing. A radial passageway is also provided in the annular wall surrounding the swirl cavity and is located approximately 90° from the tangential passageway, such that rotation of the cap approximately 120° from an "OFF" position clockwise will place the tangential passageways in the annular wall and the cylinder, respectively, in alignment to create a "SPRAY" position.

Then, when the cap is rotated from the "OFF" position 220° counterclockwise, the radial passageways in the annular wall and the cylinder, respectively, are aligned so that a "STREAM" or jet position is established.

SUMMARY OF THE INVENTION

According to the present invention there is provided a nozzle assembly for a trigger sprayer comprising a nose bushing and a nozzle cap rotatably mounted on the nose bushing. The nose bushing has a front core with a front face and a generally cylindrical periphery. The generally cylindrical periphery has first, second and third, angularly spaced apart, longitudinally extending channels therein which open onto the front face of the core and extend rearwardly therefrom. The nozzle cap includes a front wall having a back side and a cylinder having an inner cylindrical wall surface and extending rearwardly from the back side of the front wall to a rear end of the cylinder. The front wall has a discharge orifice therethrough and the back side of the front wall has a swirl chamber formed therein in the area of and communicating with the discharge orifice. The back side also has first and second non diametrically disposed radial slots therein that extend radially inwardly from the cylindrical wall surface to the swirl chamber and first and second non diametrically disposed tangential slots therein that are angularly offset from the radial slots and that extend from the cylindrical wall surface tangentially to the swirl chamber. The nozzle cap is rotatable on the nose bushing counterclockwise or clockwise 90° between an "OFF" position and a "SPRAY" position where the second and third channels are aligned with respective ones of the first and second tangential slots and clockwise or counterclockwise 90° between the "OFF" position and a "STREAM" position where the first and third channels are aligned with respective ones of the first and second radial slots.

DESCRIPTION OF THE PREFERRED EMBODIMENT(S)

Figure 11:
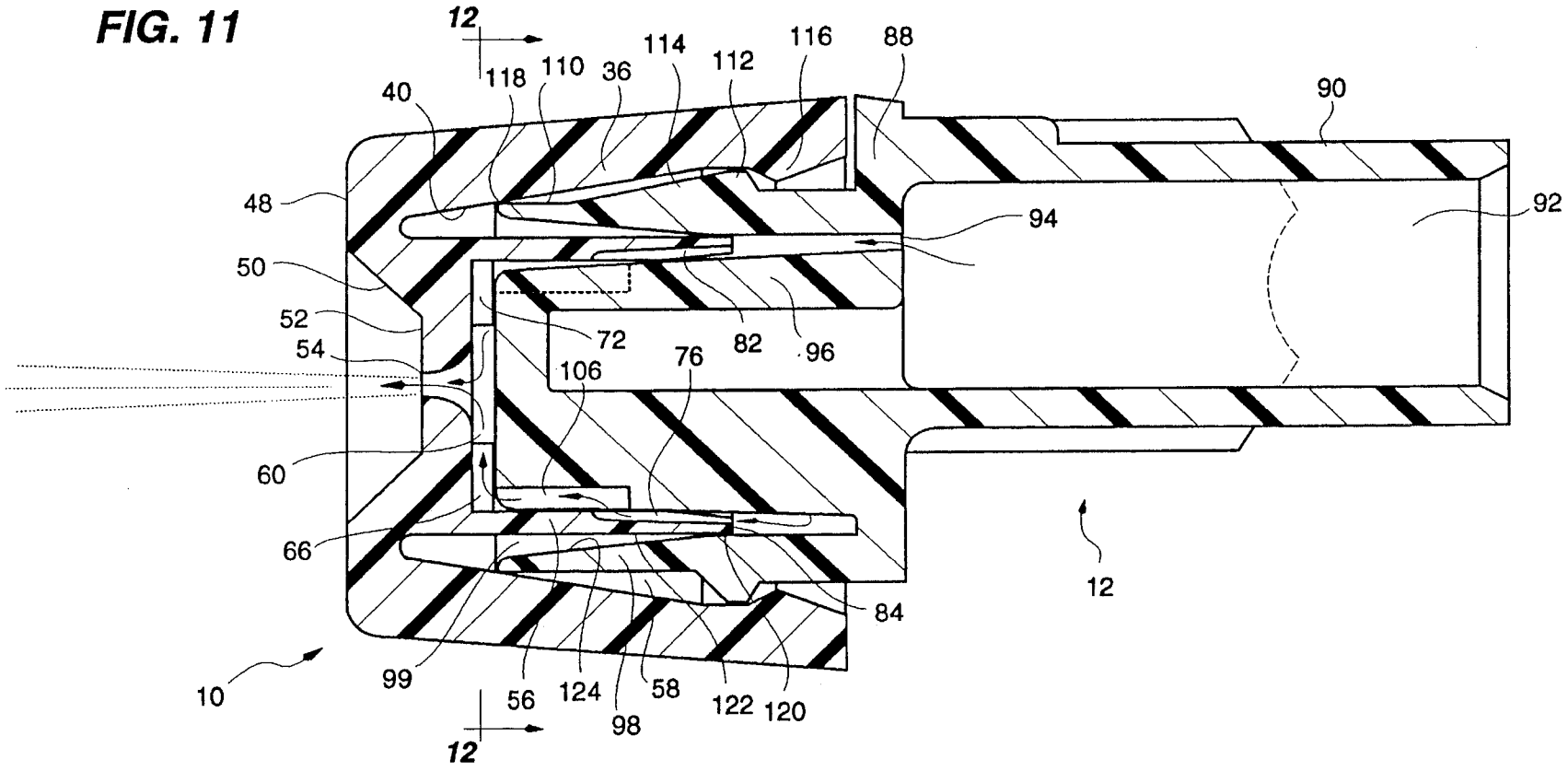
FIG. 11 is a longitudinal sectional view of the nozzle assembly of the nozzle cap on the nose bushing with the nozzle cap rotated 90° from an "OFF" position (FIG. 13) to a position defining a "STREAM" mode of operation of the nozzle assembly.

A nozzle assembly constructed according to the teachings of the present invention is shown in FIG. 11 and comprises two main integral parts, namely a nozzle cap 10, FIGS. 1–4 and 9, and a nose bushing 12, FIGS. 5–8 and 10.

Referring now to FIGS. 1–4, the nozzle cap 10 includes a generally rectangular outer shroud 14 having four sides 16, 18, 20, 22. One side 16 of the outer shroud 14 of the nozzle cap 10 has "OFF" position indicia 24 thereon, which, when the nozzle cap 10 is in a first position on the nose bushing 12 with the side 16 facing upwardly, indicates that the nozzle cap 10 is in an "OFF" position.

A second side 18 of the outer shroud 14 of the nozzle cap 10, which is generally perpendicular to the first side 16, has "SPRAY" position indicia 26 thereon, which, when the nozzle cap 10 is rotated counterclockwise 90° from the "OFF" position to a second position where the side 18 faces upwardly, indicates that the nozzle cap 10 is in a "SPRAY" position.

Figure 1:
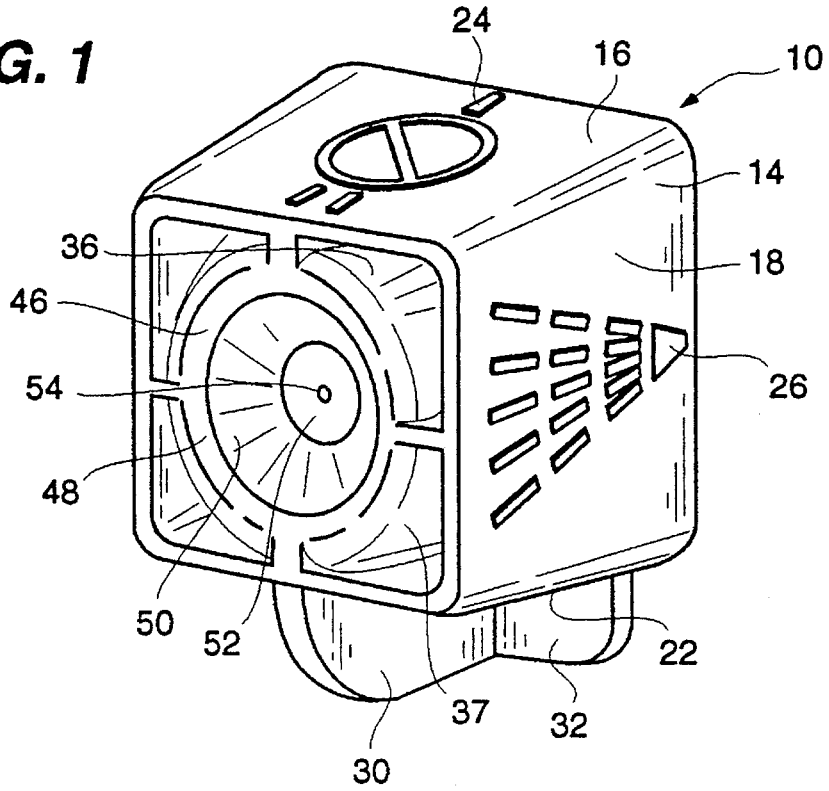
FIG. 1 is a front perspective view of a nozzle cap of an adjustable nozzle assembly constructed in accordance with the teachings of the present invention.
Figure 2:
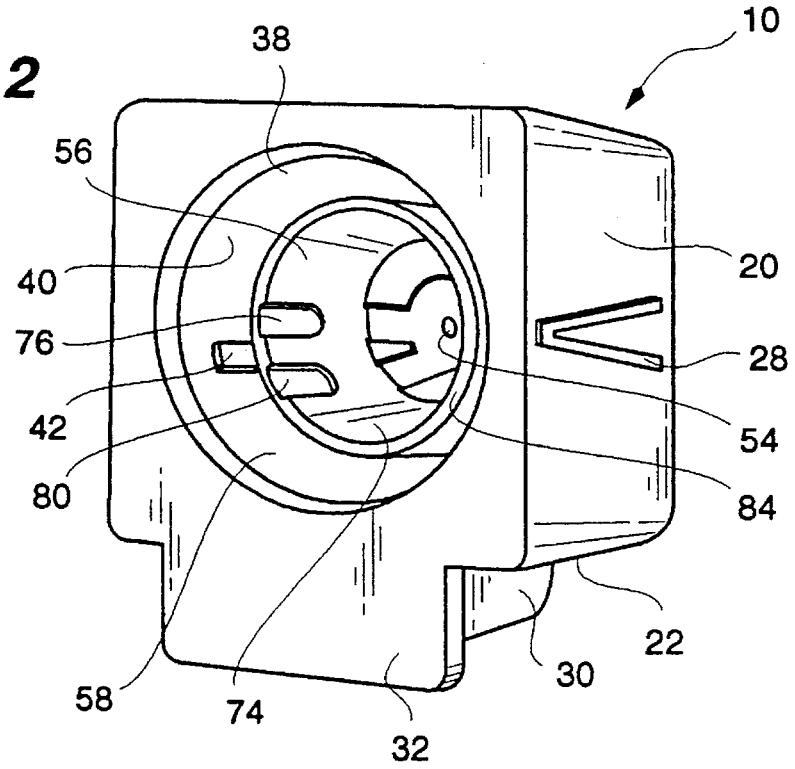
FIG. 2 is a rear perspective view of the nozzle cap shown in FIG. 1.
Figure 3:
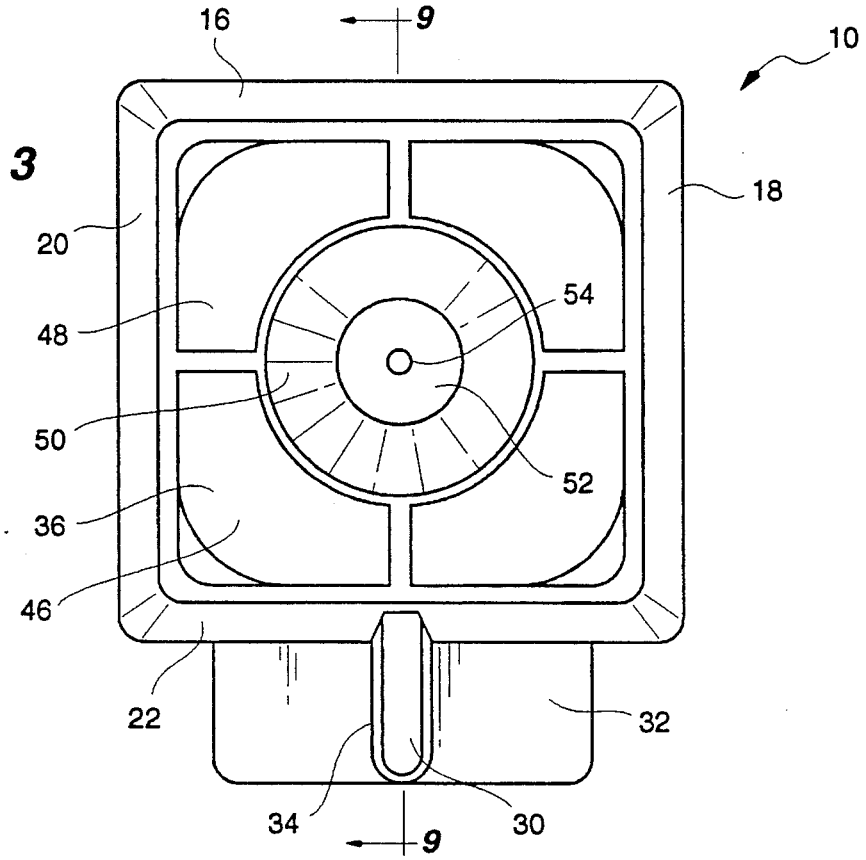
FIG. 3 is a front view of the nozzle cap shown FIG. 1.

Similarly, as shown in FIG. 2, a third side 20 of the outer shroud 14 of the nozzle cap 10, which is perpendicular to the first side 16 and opposite the second side 18, has "STREAM" position indicia 28 thereon, which, when the nozzle cap 10 is rotated clockwise 90° from the "OFF" position to a third position where the side 20 faces upwardly, indicates that the nozzle cap 10 is in a "STREAM" position.

A fourth side 22 of the rectangular outer shroud 14 of the nozzle cap 10 is perpendicular to the second and third sides 18 and 20 and opposite the first side 16. Two flanges 30, 32 are mounted on the fourth side 22. The flanges 30, 32 extend perpendicularly outwardly from the fourth side 22 and are perpendicular to each other. The perpendicular flanges 30, 32 form a gripping surface 34 so that a person can easily grip the nozzle cap 10 and, when the nozzle cap 10 is mounted on the nose bushing 12, can rotate the nozzle cap 10 about the nose bushing 12.

A cylindrical or thimble shaped formation 36 is located within the rectangular shroud 14 of the nozzle cap 10 and a front wall 37 of the formation 36 is connected by webbings to all four sides 16, 18, 20, 22 of the shroud. The cylindrical or thimble shaped formation 36 extends rearwardly to an open end 38.

The nozzle cap 10 has an inner generally conical surface 40 as shown in FIG. 2. Two stop flanges 42, 44 are positioned on the inner conical surface 40 of the nozzle cap 10 and are positioned less than 180° apart but more than 120° apart. Preferably, the stop flanges 42, 44 are spaced approximately 155° apart.

The front wall 37 has a front wall or just front surface 48 with a tapered annular surface 50 which leads to a smaller circular surface 52 of the front wall 37. The front wall 37 has an outlet or discharge orifice 54 therethrough opening onto the front surface 48 so that liquid can be dispensed from the nozzle cap 10.

Figure 4:
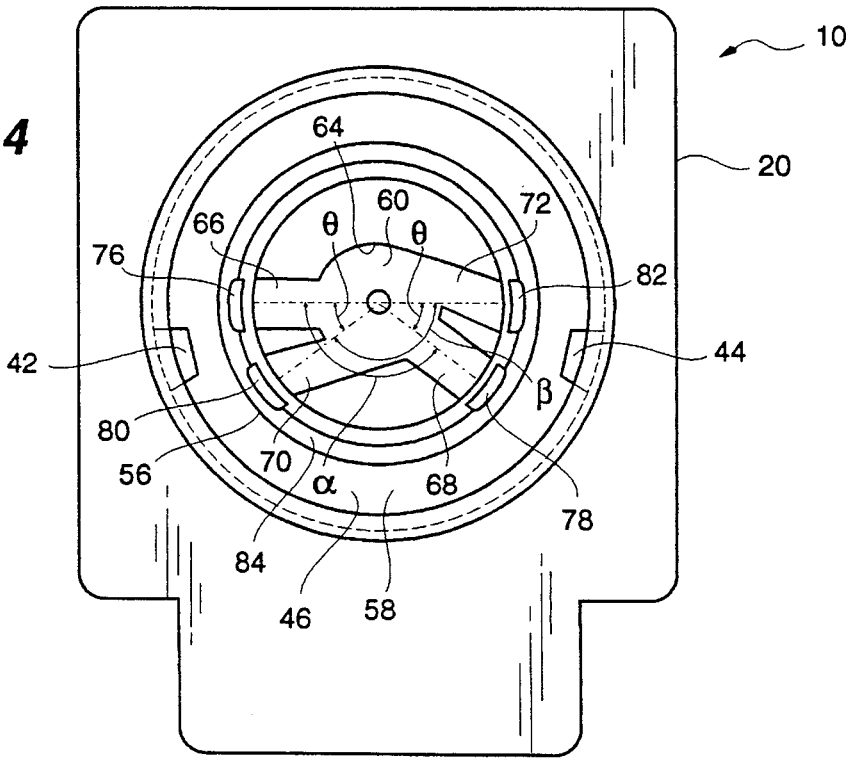
FIG. 4 is a rear view of the nozzle cap shown in FIG. 2.
Figure 5:
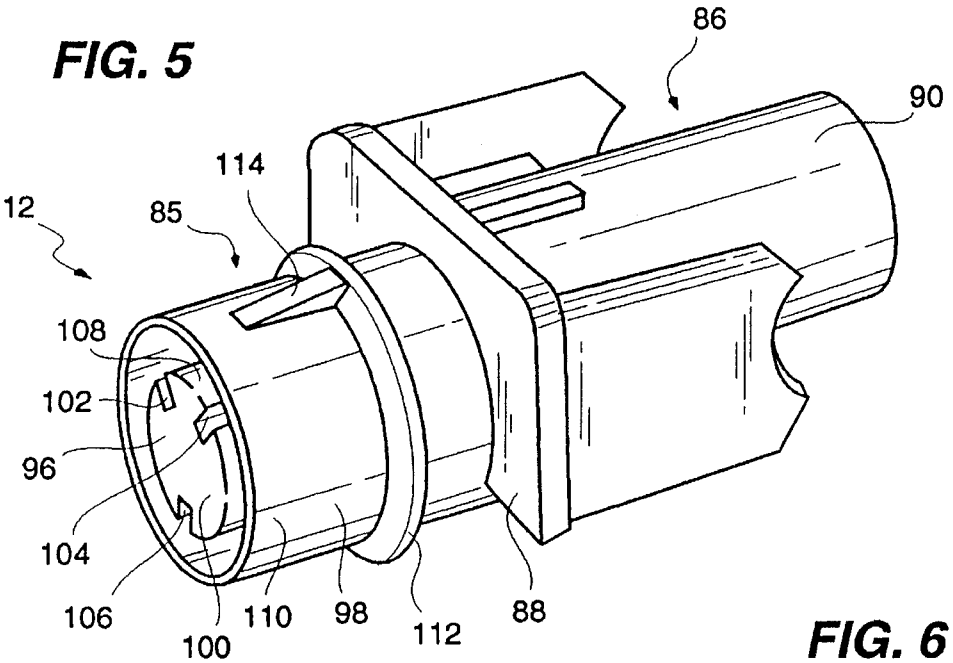
FIG. 5 is a front perspective view of a nose bushing of the nozzle assembly constructed according to the teachings of the present invention.
Figure 6:
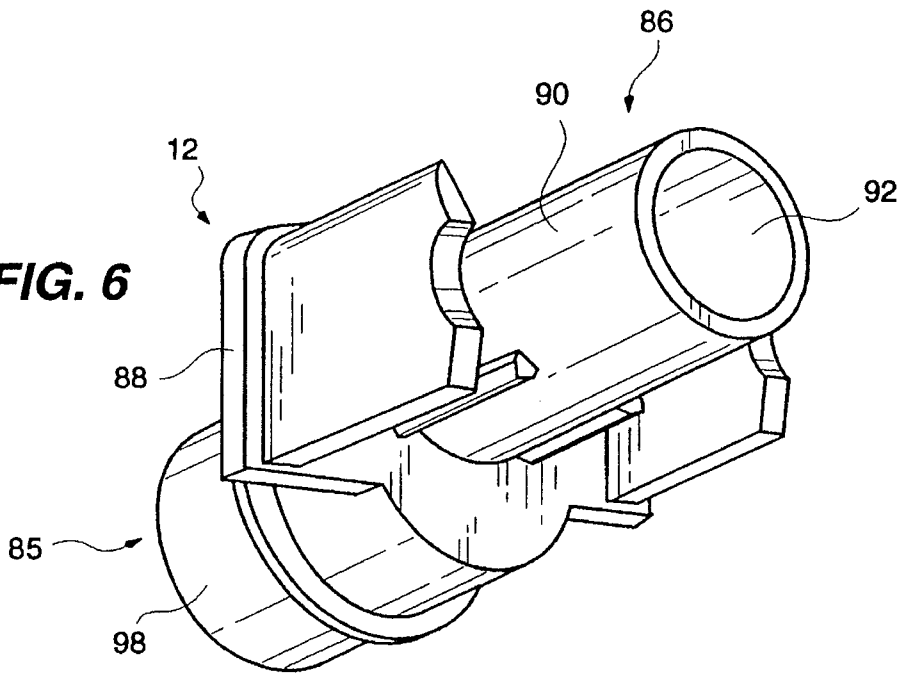
FIG. 6 is a rear perspective view of the nose bushing shown in FIG. 5.
Figure 9:
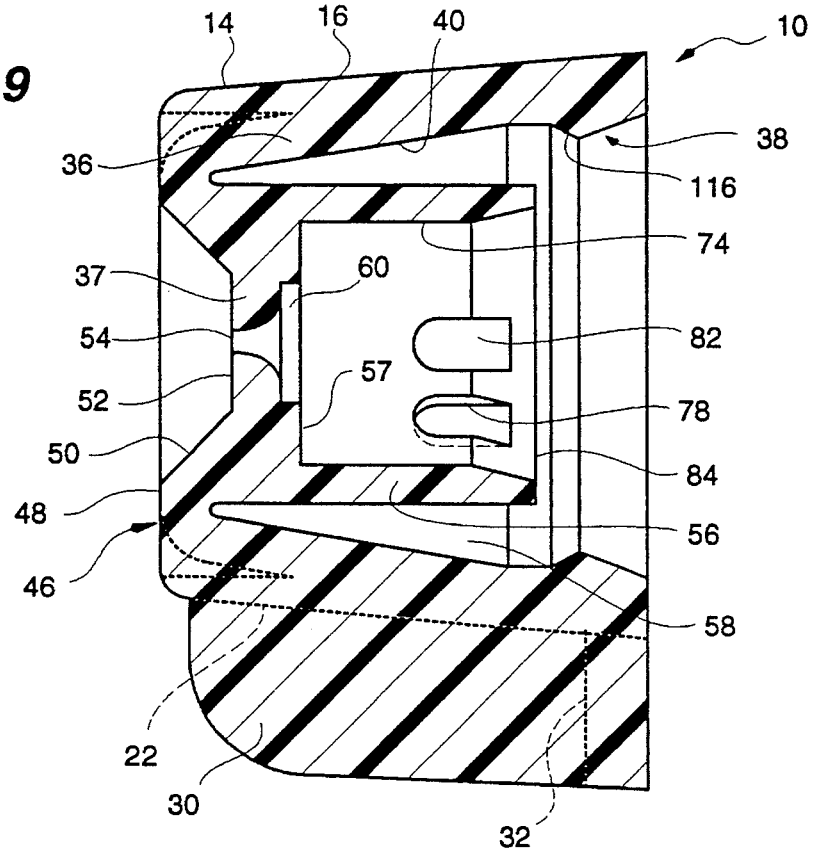
FIG. 9 is a longitudinal sectional view of the cap shown in FIG. 3 taken and is taken along line 9—9 of FIG. 3.
Figure 10:
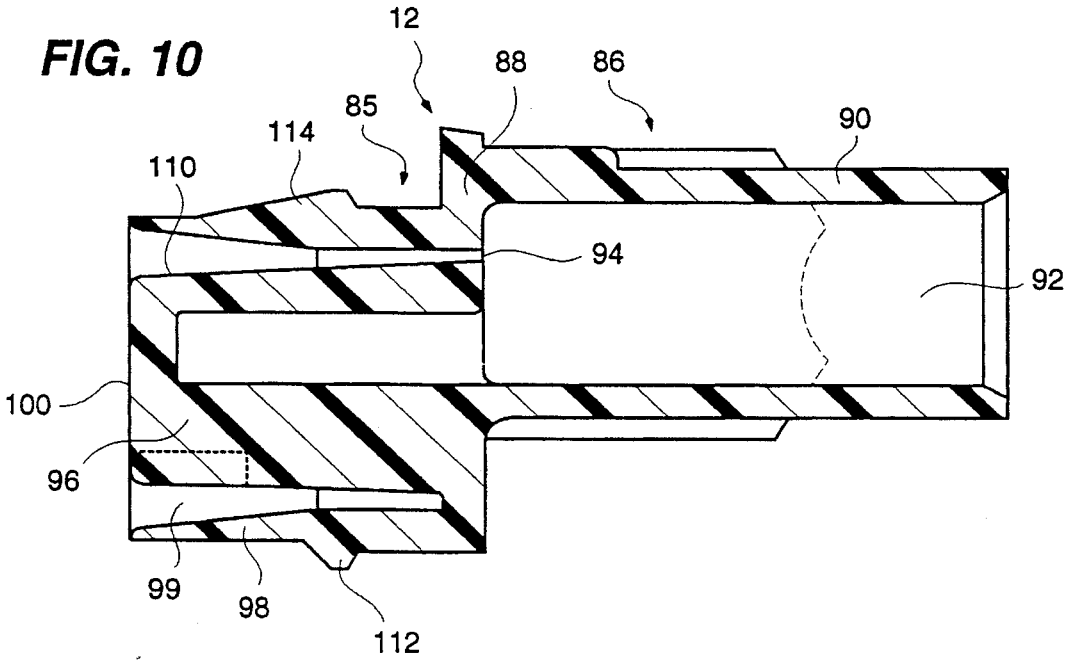
FIG. 10 is a longitudinal sectional view of the nose bushing shown in FIG. 7 and is taken along line 10—10 of FIG.7.

As shown in FIGS. 2, 4 and 9 the cylindrical or thimble formation 36 of the nozzle cap 10 has an annular skirt or cylinder 56 which extends rearwardly from a back side 57 (FIG. 9) of the front wall 37. A large annular slot 58 is defined between the conical inner surface 40 of the nozzle cap 10 and the cylinder 56.

A swirl chamber 60 is situated in the back side 57 of the front wall 37 of the nozzle cap 10. The swirl chamber 60 is defined by a generally cylindrical wall 64 in the back side 57 of the front wall 37. Two radial slots 66, 68 and two tangential slots 70, 72 are also formed in the back side 57 of the front wall 37. The slots 66, 68, 70, 72 communicate with the swirl chamber 60.

An inner surface 74 of the cylinder 56 has four grooves 76, 78, 80, 82 therein which extend forwardly from a rear edge 84 of the cylinder 56. Two of the grooves 76, 78 are aligned with the radial slots 66, 68 in the front wall 37 and two of the grooves 80, 82 are aligned with the tangential slots 70, 72 in the front wall 37.

According to the teachings of the present invention, only two radial slots 66, 68 and two tangential slots 70, 72 are provided in the back side 57 of the front wall 37 and the slots are not aligned on a diameter as in the Micallef U.S. Pat. No. 3,967,765 or the Quinn et. al. U.S. Pat. No. 4,234,128. Furthermore, only two radial slots 66, 68 and two tangential slots 70, 72 are provided instead of three grooves, slots, notches or channels, as taught by the Dobbs U.S. Pat. No. 4,706,888. Further, the radial slots 66, 68 and the tangential slots 70, 72 are arranged at angles greater than 60°, which is taught in the Dobbs patent and less than 180° as taught by the Micallef and Quinn et al. In this respect, and as shown in FIG. 4, center lines of the radial slots 66 and 68 intersect each other at an angle $\alpha$ of approximately 143° which can vary plus or minus 20°. The tangential slots 70 and 72 are displaced from each other by an angle $\alpha$ of approximately 143° which can vary plus or minus 20°. The first radial slot 66 is angularly spaced from the closest angularly adjacent tangential slot 70 by an angle $\theta$ of approximately 40°± 10°. Likewise the second radial slot 68 is angularly spaced from the closest angularly adjacent tangential slot 72 by the same angle $\theta$ of approximately 40°± 10°.

The nozzle cap 10 is adapted to be rotatably mounted to the nose bushing 12 which is shown in FIGS. 5, 6, 7, 8 and 10 and described below.

The nose bushing 12 has a front portion 85 and a rear portion 86 which are separated by a vertical wall 88. The rear portion 86 of the nose bushing 12 is adapted to be positioned on the front end of a trigger sprayer (not shown) and includes a cylindrical portion 90 having an axial passageway or waterway 92 therethrough. Liquid can flow from the trigger sprayer through the waterway 92 and into the front portion 85 of the nose bushing 12 via a longitudinally extending arcuate slot 94 in the vertical wall 88 that has an inner surface which is coextensive with part of a cylindrical core 96.

The front portion 85 of the nose bushing 12 includes the core 96 surrounded by an outer annular or cylindrical skirt 98. An annular space 99 is defined between the core 96 and the outer cylindrical skirt 98.

The cylindrical core 96 has a circular front face 100 and three channels 102, 104, 106 in an outer surface 108 of the core 96. The first and second channels 102, 104 are equally angularly spaced from the third channel 106.

Figure 7:
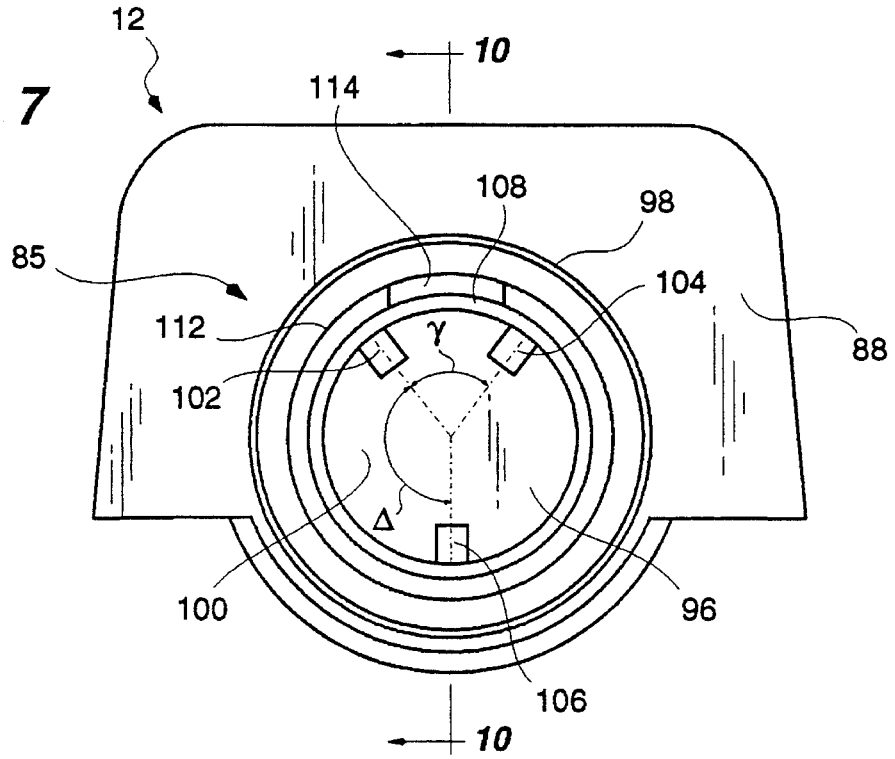
FIG. 7 is a front elevational view of the nose bushing shown in FIG. 5.
Figure 8:
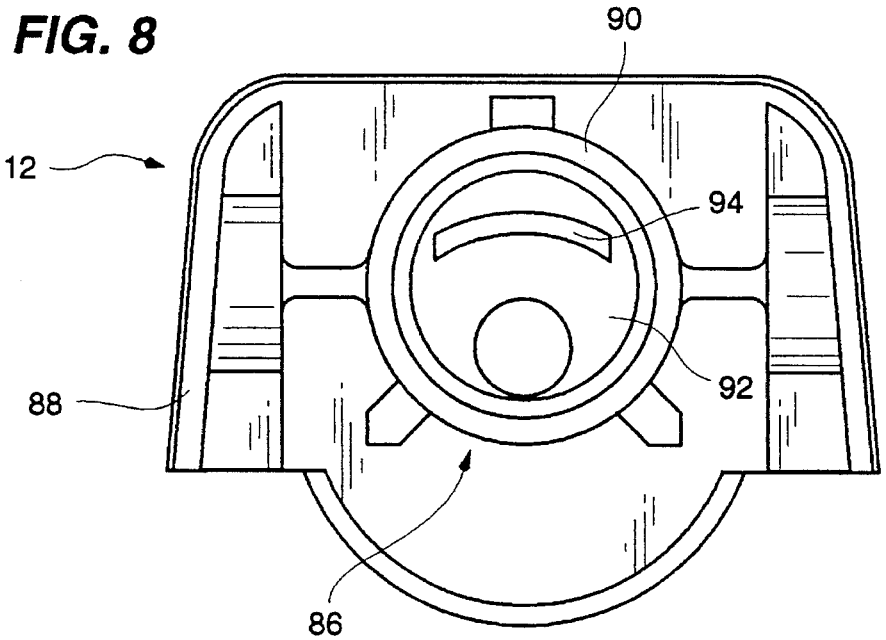
FIG. 8 is a rear elevational view of the nose bushing shown in FIG. 6.

According to the teachings of the present invention, as best shown in FIG. 7, the three channels 102, 104 and 106 are angularly displaced from each other by angles $\gamma$ and $\Delta$. The channels 104 and 106 extend into the circular front face 100 of the core or post 96 and are displaced by angles $\gamma$ and $\Delta$.

The cylindrical core has a circular front face 100 and three channels 102, 104 and 106 which extend angularly from the periphery of the core 96 into the core and into the circular front face 100 so as to form a generally Y configuration with the slots 102 and 104 being separated by an angle $\gamma$ and the slots 104 and 106 and 106 and 102 being separated by an angle $\Delta$.

According to the teachings of the present invention, and as best shown in FIG. 7, the angle $\gamma$ is 74° plus or minus 20° and the angle $\Delta$ is 143° plus or minus 20°.

The three channels 102, 104, 106 extend longitudinally rearwardly from the front face 100 of the cylindrical core 96 toward, but not all the way to the vertical wall 88.

The outer cylindrical skirt 98 of the front portion 85 of the nose bushing 12 has an outer surface 110 with an annular ridge 112 thereon. A stop flange 114 is mounted on the outer cylindrical surface 110 and, as shown, the stop flange 114 is triangular and abuts the annular ridge 112.

When the nozzle cap 10 is rotatably mounted on the nose bushing 12, the triangular stop flange 114 of the nose bushing 12 alternately cooperates with stop flanges 42, 44 on the nozzle cap 10 to ensure proper rotation of the cap 10 into the "SPRAY" and "STREAM" positions. The nozzle cap 10 can be rotated counterclockwise 90° from the "OFF" position to the "SPRAY" position. The nozzle cap 10 also can be rotated clockwise 90° from the "OFF" position to a "STREAM" position, as will be described below with reference to FIGS. 12–14.

Referring now to FIG. 11, there is shown therein a cross-sectional view of the nozzle cap 10 rotatably mounted to the nose bushing 12. As shown, the nozzle cap 10 is in the "STREAM" position. Note that the nozzle cap 10 is prevented from becoming separated from the nose bushing 12 due to the snap fit of a radially inwardly extending annular rib on the conical inner surface 40 of the cap over the annular ridge 112 when the cap 10 is mounted on the nose bushing 12.

The radial slots 66, 68 in the nozzle cap 10 are aligned with two of the channels 106, 102 of the cylindrical core 96, one channel 106 being shown in FIG. 11. Further, the grooves 76, 78 in the nozzle cap that cooperate with the radial slots 66, 68 also are aligned with the same two channels 106, 102 in the nose bushing 12, forming a continuous passageway from the waterway 92 through the annular slot 99 to the swirl chamber 60.

In the "STREAM" position, the tangential grooves 70, 72, are not aligned with any of the channels 102, 104, 106 in the core 96.

In the "STREAM" position, liquid is allowed to flow from the waterway 92 in the rear portion 86 of the nose bushing 12, through the arcuate slot 94 in the vertical wall 88 of the nose bushing 12 into the annular space 99 between the core 96 and the cylindrical skirt 98 of the front portion 85 of the nose bushing 12.

Then, because the radial slots 66, 68 and the grooves 76, 78 are aligned with the channels 106, 102 in the nose bushing 12, liquid under pressure is allowed to flow from the annular space 99 through the grooves 76, 78 into the channels 106, 102 in the core 96, into the radial slots 66, 68 in the nozzle cap 10 and then into the swirl chamber 60. The fluid enters the swirl chamber 60 in a radial direction and exits the swirl chamber 60 through the orifice 54 in a stream pattern.

In the "STREAM" position, fluid cannot enter the swirl chamber 60 through the tangential slots 70, 72 because the tangential slots 70, 72 are not aligned with the channels 102, 104, 106 in the core 96 of the nose bushing 12.

When the nozzle cap 10 is mounted on the front portion 85 of the nose bushing 12, a front seal 118 is formed along the conical inner surface 40 of the thimble shaped formation 36 and the outer surface 110 of the outer cylindrical skirt 98 of the nose bushing 12. A rear seal 120 is formed along an outer surface 112 of the annular skirt 56 of the cap 10 and an inner surface 124 of the outer cylindrical skirt 98 of the nose bushing 12. Both the front and rear seals 118, 120 are maintained in each position of the nozzle cap 10 and prevent leakage of fluid from the nozzle assembly during operation of the sprayer.

Figure 12:
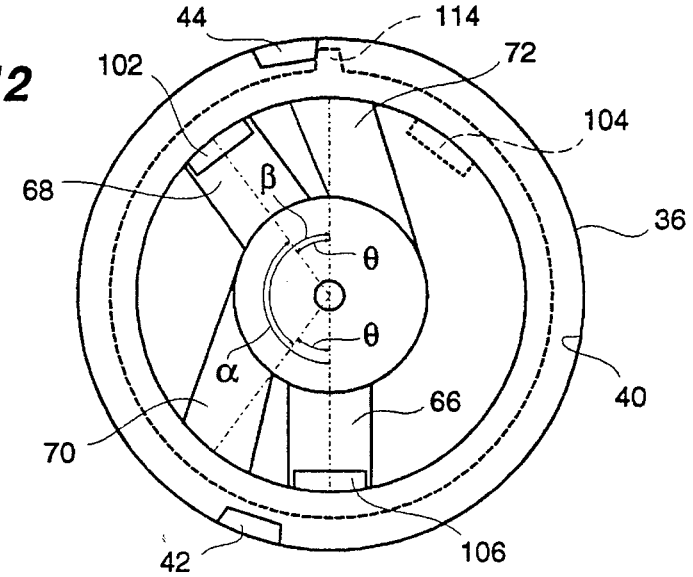
FIG. 12 is a transverse, vertical, sectional view through the assembly of the nozzle cap on the nose bushing with the nozzle cap rotated to the "STREAM" position and is taken along line 12—12 of FIG. 11.
Figure 13:
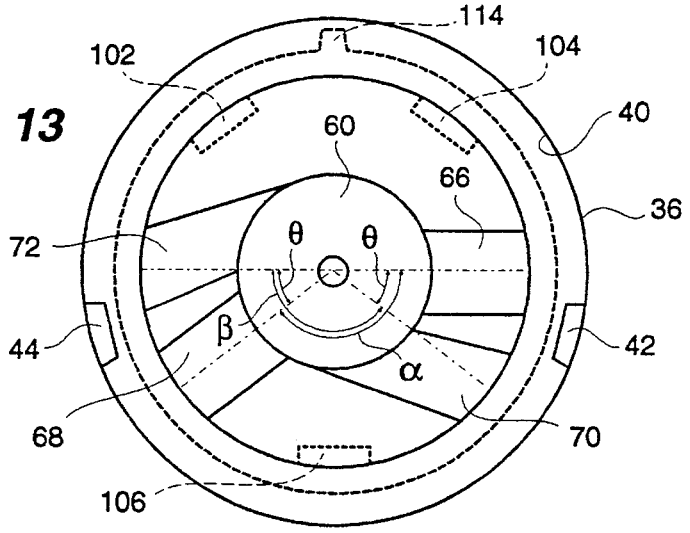
FIG. 13 is a transverse, vertical, sectional view through the assembly of the nozzle cap on the nose bushing, similar to the sectional view shown in FIG. 12, but with the nozzle cap rotated counterclockwise 90° from the "STREAM" position shown in FIG. 12 to the "OFF" position shown in FIG. 13.
Figure 14:
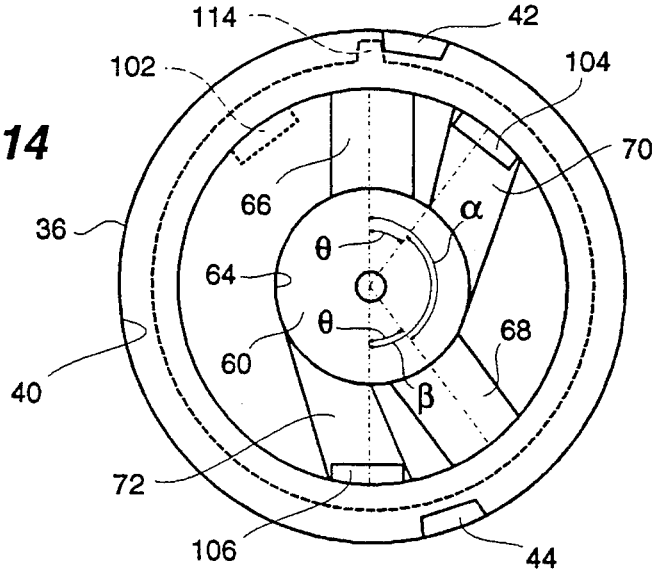
FIG. 14 is a transverse, vertical, sectional view through the assembly of the nozzle cap on the nose bushing, similar to the sectional view shown in FIG. 12, but with the nozzle cap rotated clockwise 90° from the "OFF" position shown in FIG. 13 to a "SPRAY" position shown in FIG. 14.

Referring now to FIGS. 12–14, the operation and cooperation of the channels 102, 104, 106 with the slots 66, 68, 70, 72 and the grooves 76, 78, 80, 82 is described in greater detail.

In the "STREAM" position shown in FIG. 12, the nozzle cap 10 is rotated 90° clockwise from the "OFF" position. When in the "STREAM" position, the two radial slots 66, 68 in the nozzle cap 10 are aligned with two channels 102, 106 in the nose bushing 12. Similarly, the two cooperating grooves 76, 78 (not shown) in the nozzle cap 10 are also aligned and communicate with the channels 102, 106 on the nose bushing 12.

In the "STREAM" position liquid is allowed to flow from the annular space 99 in the front portion 85 of the nose bushing 12 through the two grooves 76, 78, into the channels 102, 106 in the nose bushing 12, to the radial slots 66, 68 in the nozzle cap 10 and then into the swirl chamber 60. The liquid enters the swirl chamber 60 in a radial direction and exits the orifice in a stream pattern.

Note also that when the nozzle cap 10 is in the "STREAM" position, the other stop flange 44 on the conical inner surface 40 of the thimble shaped formation 36 engages the stop flange 114 on the nose bushing 12, preventing further rotation of the nozzle cap 10 in a clockwise direction as shown.

As shown in FIG. 13, the nozzle cap is rotated 90° counterclockwise from the "STREAM" position shown in FIG. 12 to an "OFF" position. In the "OFF" position, none of the slots 66, 68, 70, 72 or grooves 76, 78, 80, 82 in the nozzle cap 10 are aligned with the channels 102, 104, 106 in the nose bushing 12.

Since none of the slots 66, 68, 70, 72 or cooperating grooves 76, 78, 80, 82 are aligned with the channels 102, 104, 106, liquid cannot pass into the swirl chamber 60.

Note also that when the nozzle cap 10 is in the "OFF" position, neither of the stop flanges 42, 44 on the conical inner surface 40 of the thimble shaped formation 36 engage the stop flange 114 on the nose bushing 12.

In FIG. 14, the nozzle cap 10 is shown positioned on the nose bushing 12 in a "SPRAY" position after the nozzle cap has been rotated counterclockwise 90° from the "OFF" position shown in FIG. 13. When in the "SPRAY" position, the two tangential slots 70, 72 in the nozzle cap 10 are aligned with two of the channels 104, 106 of the nose bushing 12. Also, two of the grooves 80, 82 (not shown in FIG. 12) in the nozzle cap 10 that are aligned with the tangential slots 70, 72 are also aligned with the two channels 104, 106 in the nose bushing.

Fluid can then flow from the annular slot 99 in the front portion 85 of the nose bushing 12, through the two grooves 80, 82 in the nozzle cap 10, and into the two slots 104, 106 of the nose bushing 12. The fluid can then flow into the tangential slots 70, 72 in the nozzle cap 10 and into the swirl chamber 60 in a radial direction. The fluid then swirls around the swirl chamber 60 and exits the orifice 54 in a spray pattern.

Note also that when the nozzle cap 10 is in the "SPRAY" position, one of the stop flanges 42 on the conical inner surface 40 of the thimble shaped formation 36 engages the stop flange 114 on the nose bushing 12, preventing further rotation of the nozzle cap 10 in a counter-clockwise direction as shown.

From the foregoing description, it will be apparent that the nozzle assembly and swirl chamber configuration therein of the present invention has a number of advantages, some of which have been described above and others of which are inherent in the invention. Also, it will be understood that modifications can be made to the nozzle assembly and swirl chamber configuration therein without departing from the teachings of the present invention. Accordingly, the scope of the invention is only to be limited as necessitated by the accompanying claims.

I claim:

1. A nozzle assembly for a trigger sprayer comprising:

a nose bushing;

a nozzle cap rotatably mounted on said nose bushing;

said nose bushing having a front core with a front face and a generally cylindrical periphery;

said generally cylindrical periphery having first, second and third, angularly spaced apart, longitudinally extending channels therein which open onto said front face of said core and extend rearwardly therefrom;

said nozzle cap including a front wall having a back side and a cylinder having an inner cylindrical wall surface and extending rearwardly from said back side of said front wall to a rear end of said cylinder;

said front wall having a discharge orifice therethrough;

said back side of said front wall having a swirl chamber formed therein in the area of and communicating with said discharge orifice, first and second nondiametrically disposed radial slots therein that extend radially inwardly from said cylindrical wall surface to said swirl chamber and first and second nondiametrically disposed tangential slots therein that are angularly offset from said radial slots and that extend from said cylindrical wall surface tangentially to said swirl chambers; and, said nozzle cap being rotatable on said nose bushing counterclockwise or clockwise 90° between an "OFF" position and a "SPRAY" position where said second and third channels are aligned with respective ones of said first and second tangential slots and clockwise or counterclockwise 90° between said "OFF" position and a "STREAM" position where said first and third channels are aligned with respective ones of said first and second radial slots.

2. The nozzle assembly of claim 1 wherein said cylinder in said nozzle cap has four longitudinally extending grooves therein that extend forwardly from said rear end of said cylinder toward but not to said back side of said front wall with each groove being in alignment with one of said radial or tangential slots and each groove opening at said rear end of said cylinder to an annular space communicating with a waterway in said nose bushing,

3. The nozzle assembly of claim 2 wherein said channels, said grooves, said radial slots and said tangential slots are arranged so that when said nozzle cap is in said "SPRAY" position two of said grooves communicate with said second and third channels which communicate with said tangential slots and when said nozzle cap is in said "STREAM" position the other two of said grooves communicate with said first and third channels which communicate with said radial slots.

4. The nozzle assembly of claim 1 wherein said nozzle cap and said nose busing have cooperating stop means which limit rotation of said cap 90° clockwise or counterclockwise from said "OFF" position.

5. The nozzle assembly of claim 1 wherein said nose bushing further includes an annular skirt around said core defining an annular space between said core and said skirt, said nose bushing having passage means communicating said annular space with a waterway in said nose bushing and said rear end of said cylinder in said cap being received in said annular space.

6. The nozzle assembly of claim 5 wherein said annular skirt has on an outer periphery thereof an annular ridge, said nozzle cap has a generally conical inner surface spaced from an outer periphery of said cylinder, and said conical inner surface having a radially inwardly extending annular rib thereon, said annular rib being snap-fittingly received over said annular ridge when said cap is mounted on said nose bushing.

7. The nozzle assembly of claim 1 wherein said nozzle cap has a generally box shaped outer shroud having four sides with indicia on three of said sides for indicating said "OFF" position, said "SPRAY" position and said "STREAM" position.

8. The nozzle assembly of claim 1 wherein said nozzle cap further includes a flange formation extending laterally outwardly therefrom whereby a user of the nozzle assembly can easily grip said flange formation to rotate said nozzle cap on said nose bushing.

9. The nozzle assembly of claim 1 wherein said first and second channels are angularly spaced apart approximately 74°±20° from each other.

10. The nozzle assembly of claim 1 wherein first and third and said second and third channels are angularly spaced apart approximately 143°± 20° from each other.

11. The nozzle assembly of claim 1 wherein said first and second radial slots are angularly spaced from each other more than 60° and less than 180°.

12. The nozzle assembly of claim 1 wherein said first and second tangential slots are angularly spaced from each other more than 60° and less than 180°.

13. The nozzle assembly of claim 1 wherein said first and second radial slots are angularly spaced from each other approximately 143°±20°.

14. The nozzle assembly of claim 1 wherein said first and second tangential slots are angularly spaced from each other approximately 143°±20°.

15. The nozzle assembly of claim 1 wherein said first radial slot is angularly spaced from the closest angularly adjacent tangential slot approximately 40°±10°.

16. The nozzle assembly of claim 1 wherein said first tangential slot is angularly spaced from the closest angularly adjacent radial slot approximately 40°±10°.

* * * * *

UNITED STATES PATENT AND TRADEMARK OFFICE

CERTIFICATE OF CORRECTION

PATENT NO. : 5,526,985

DATED : June 18, 1996

INVENTOR(S) : Douglas S. Martin

It is certified that error appears in the above-indentified patent and that said Letters Patent is hereby corrected as shown below:

Column 5, line 64 "angle α" should be —angle β—.

Signed and Sealed this

Seventh Day of January, 1997

Bruce Lehman

*Attest:*

BRUCE LEHMAN

*Attesting Officer*

*Commissioner of Patents and Trademarks*